US011235217B2

(12) United States Patent
Lyall et al.

(10) Patent No.: US 11,235,217 B2
(45) Date of Patent: Feb. 1, 2022

(54) COACHING TOOL FOR FOOTWORK DEVELOPMENT

(71) Applicant: Drive Step Products LLC, Ann Arbor, MI (US)

(72) Inventors: Patrick Lyall, Ann Arbor, MI (US); Michael Przybylek, Spring Lake, MI (US)

(73) Assignee: Drive Step Products LLC, Ann Arbor, MI (US)

( * ) Notice: Subject to any disclaimer, the term of this patent is extended or adjusted under 35 U.S.C. 154(b) by 114 days.

(21) Appl. No.: 16/272,451

(22) Filed: Feb. 11, 2019

(65) Prior Publication Data

US 2020/0254319 A1 Aug. 13, 2020

Related U.S. Application Data

(60) Provisional application No. 62/629,227, filed on Feb. 12, 2018.

(51) Int. Cl.
*A63B 69/00* (2006.01)

(52) U.S. Cl.
CPC ..... *A63B 69/002* (2013.01); *A63B 2243/007* (2013.01)

(58) Field of Classification Search
CPC ..... A63B 53/00; A63B 21/008; A63B 53/06; A63B 69/36; A63B 59/70; A63B 53/04; A63B 69/002
See application file for complete search history.

(56) References Cited

U.S. PATENT DOCUMENTS 2,004,968 A * 6/1935 Young ..... A63B 53/04 473/343
3,042,409 A * 7/1962 Johnson ..... A63B 69/3685 473/254
3,319,964 A * 5/1967 Steinberg ..... A63B 69/3685 473/230
3,561,200 A * 2/1971 Minunno ..... A01D 34/02 56/16.6
3,785,652 A * 1/1974 Ghovanloo ..... A63H 33/02 273/126 R
3,874,668 A * 4/1975 Flege ..... A63B 69/3685 473/227
4,038,719 A * 8/1977 Bennett ..... B25G 1/102 16/430
4,907,799 A * 3/1990 Danner ..... A63D 15/105 473/42
5,100,148 A * 3/1992 Smith ..... A63B 15/00 473/228

(Continued)

*Primary Examiner* — Eugene L Kim
*Assistant Examiner* — Christopher Glenn
(74) *Attorney, Agent, or Firm* — Honigman LLP

(57) ABSTRACT

A coaching tool for footwork development including a plurality of shims arranged parallel to one another. The coaching tool includes a housing surrounding the shims. The housing has a top surface, a bottom surface opposite the top surface, a front surface, and a back surface opposite the front surface. The coaching tool includes a handle extending from a first end to a second end. The first end is attached to the housing on the back surface, and the second end is spaced from the first end. A portion of the handle between the first end and the second end is disposed on a common plane with the bottom surface of the housing.

15 Claims, 3 Drawing Sheets

(56) References Cited

U.S. PATENT DOCUMENTS 5,207,625 A * 5/1993 White ..... A63B 21/0088 473/228
5,207,721 A * 5/1993 Lobdell ..... A63B 69/3685 473/230
5,328,185 A * 7/1994 Finnigan ..... A63B 53/007 473/294
5,403,009 A * 4/1995 Gleason, Jr. ..... A63B 69/3638 150/160
5,792,002 A * 8/1998 Bothwell ..... A63B 53/10 473/316
5,944,614 A * 8/1999 Yoon ..... A63B 53/047 473/224
6,102,810 A * 8/2000 Boland ..... A63B 60/62 150/160
6,379,261 B1 * 4/2002 Hart ..... A63B 69/3623 473/292
6,872,149 B1 * 3/2005 Devon ..... A63B 69/3685 473/231
7,749,093 B1 * 7/2010 Chang ..... A63B 69/3632 473/226
8,262,145 B2 * 9/2012 Berto ..... A01K 1/0114 294/179
2003/0162599 A1 * 8/2003 Klein ..... A63B 53/02 473/251
2003/0216191 A1 * 11/2003 Wright ..... A63B 53/0487 473/288
2005/0153791 A1 * 7/2005 Massey ..... A63B 69/3685 473/328
2006/0217213 A1 * 9/2006 Blanchard ..... F16C 35/063 473/328
2006/0252572 A1 * 11/2006 Franklin ..... A63B 53/02 473/305
2007/0207876 A1 * 9/2007 Shende ..... A63B 53/065 473/340
2009/0029793 A1 * 1/2009 Cage ..... A63B 53/04 473/324
2010/0016098 A1 * 1/2010 Tavares ..... A63B 53/0466 473/334
2011/0111876 A1 * 5/2011 Hart ..... A63B 69/0057 473/257
2012/0270668 A1 * 10/2012 Cogswell ..... A63D 5/02 473/56
2013/0161032 A1 * 6/2013 Connolly ..... A01C 7/02 172/1
2014/0342855 A1 * 11/2014 Thurman ..... G06Q 30/0621 473/564
2015/0045130 A1 * 2/2015 Roach ..... A63B 60/46 473/220
2015/0072809 A1 * 3/2015 Palumbo ..... A63B 59/70 473/560
2015/0224384 A1 * 8/2015 Timm ..... A63B 15/005 473/219
2017/0095714 A1 * 4/2017 Solheim ..... A63B 60/62

* cited by examiner

COACHING TOOL FOR FOOTWORK DEVELOPMENT

CROSS REFERENCE TO RELATED APPLICATIONS

This patent application claims priority under 35 U.S.C. § 119(e) to U.S. Provisional Application 62/629,227, filed on Feb. 12, 2018. The disclosures of this prior application is considered part of the disclosure of this application and is hereby incorporated by reference in their entireties.

BACKGROUND

In many sports, explosive takeoff from a static position may be desirable for players. For example, in the interior line play of football, it may be beneficial for football linemen to have quick and precise footwork in order to help the linemen to defeat their opponent. With better footwork, a football player is more likely to complete his assignment. For offensive linemen, stepping incorrectly can lead to less explosive takeoff which may negatively impact the offense. Better footwork may lead to an improved offense.

SUMMARY

One aspect of the disclosure provides a coaching tool for footwork development including a plurality of shims arranged parallel to one another. The coaching tool includes a housing surrounding the shims. The housing has a top surface, a bottom surface opposite the top surface, a front surface, and a back surface opposite the front surface. The coaching tool includes a handle extending from a first end to a second end. The first end is attached to the housing on the back surface, and the second end is spaced from the first end. A portion of the handle between the first end and the second end is disposed on a common plane with the bottom surface of the housing.

Implementations of the disclosure may include one or more of the following features.

The handle may include a first curve and a second curve, the first curve being between the first end and the second curve, and the second curve being between the first curve and the second end.

The handle may include a first portion extending from the first curve to the first end, a second portion between the first curve and the second curve, and a third portion between the second curve and the second end. The first portion may extend substantially perpendicular to the back surface of the housing and the third portion may extend substantially parallel to the back surface of the housing.

The coaching tool may include support struts extending from the back surface of the housing to the first portion of the handle.

The coaching tool may include a plurality of second shims, the second shims being in an alternating arrangement with the shims.

The second shims may be arranged parallel to one another.

The coaching tool may include a plurality of bolts extending through the shims and nuts attached to respective bolts.

The bolts and nuts may be housed within the housing.

The shims may be arranged in order of ascending height from the front surface of the housing to the back surface of the housing.

The handle may be removably attached to the housing.

The coaching tool may include a force sensor configured to identify a force applied to the housing.

The coaching tool may include a light-emitting source disposed in the housing. Upon recognition of a force applied to the housing, the light-emitting source may emit a light.

The coaching tool may include a sound-emitting source disposed in the housing. Upon recognition of a force applied to the housing, the sound-emitting source emits a sound.

The coaching tool may include wheels attached to one of the housing and the handle.

The coaching tool may include skis attached to one of the housing and the handle.

At least a portion of the handle may be coated in a material with a greater grip than a material of the rest of the handle.

A method for coaching footwork development, including instructing a player to move their feet to a desired location, moving the coaching tool to an undesired location, and providing kinesthetic response to the player through the coaching tool upon the player contacting the coaching tool at the undesired location.

Moving the coaching tool to the undesired location may be accomplished by grasping the handle and sliding the coaching tool to the undesired location.

The method for coaching footwork development may include the coaching tool emitting one of a light and a sound upon the player contacting the coaching tool at the undesired location.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
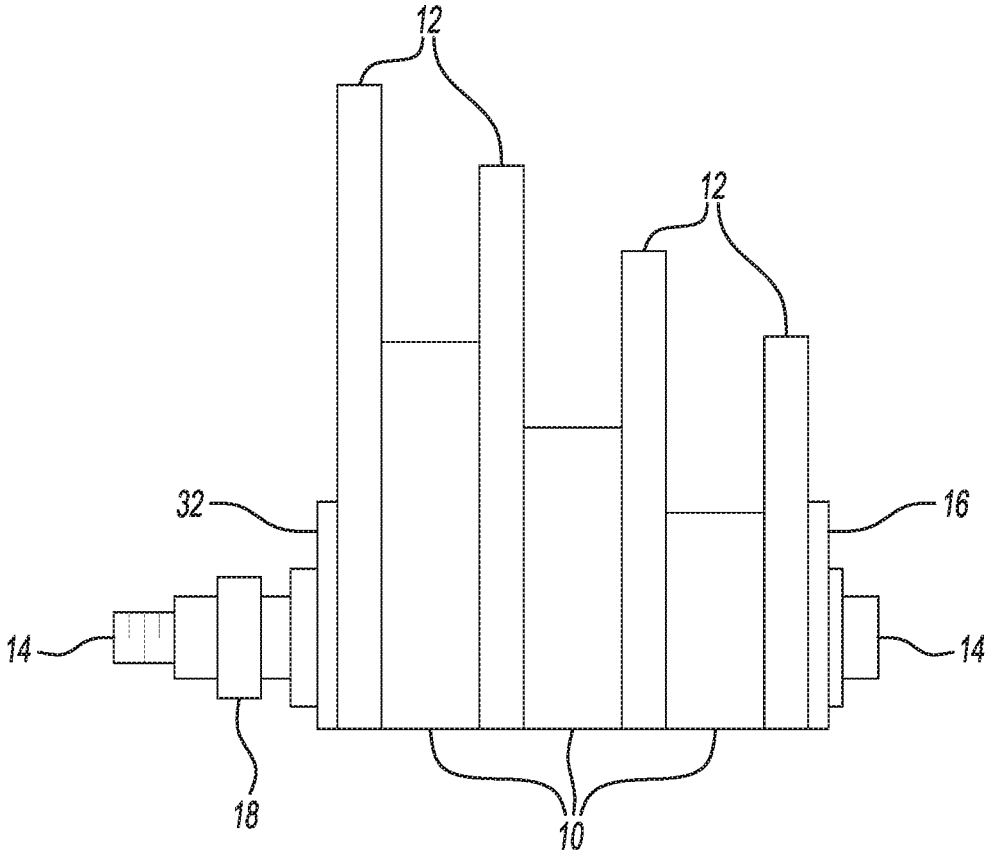
FIG. 1 is a side view of a coaching tool with a housing removed for clarity.

Referring to FIGS. 1-5, a coaching tool for footwork development is generally shown. The coaching tool includes a plurality of shims 12 arranged parallel to one another. The coaching tool includes a housing 24 surrounding the shims 12. The housing 24 has a top surface 48, a bottom surface 50 opposite the top surface 48, a front surface 44, and a back surface 46 opposite the front surface 44. The coaching tool includes a handle 26 extending from a first end 34 to a second end 36. The first end 34 is attached to the housing 24 on the back surface 46, and the second end 36 is spaced from the first end 34. A portion 38 of the handle 26 between the first end34 and the second end 36 is disposed on a common plane with the bottom surface 50 of the housing 24.

Figure 2:
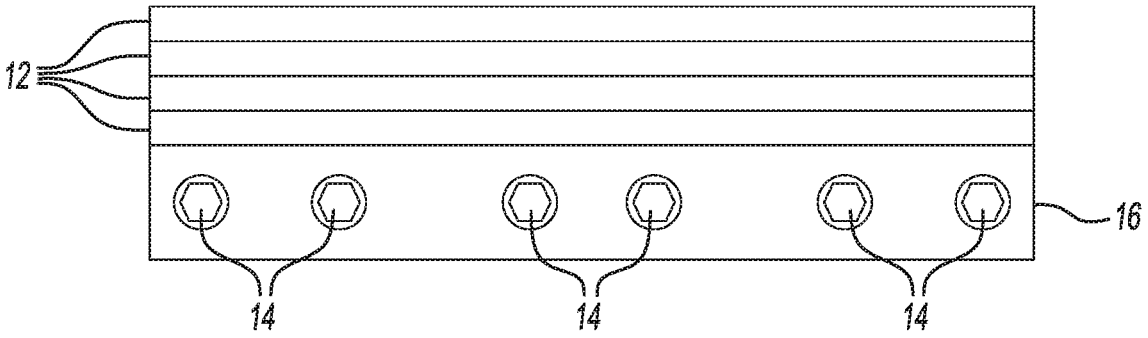
FIG. 2 is a front view of the coaching tool with the housing removed for clarity.
Figure 3:
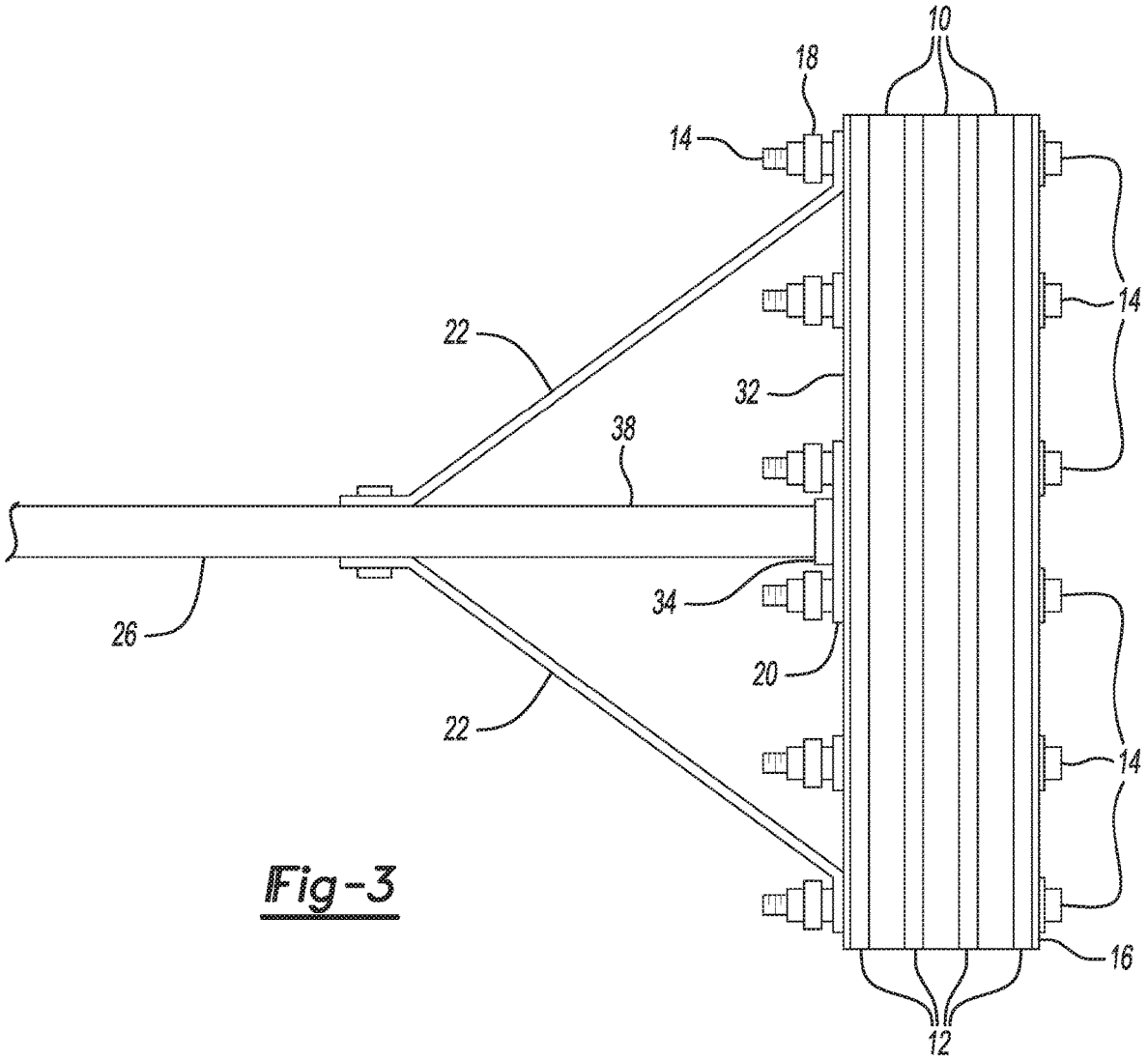
FIG. 3 is a front view of the coaching tool with the housing removed for clarity and a portion of a handle shown.

The housing 24 may include a plurality of second shims 10, the second shims 10 being in an alternating arrangement with the shims 12. The shims 12 and the second shims 10 may be arranged parallel to one another as shown in FIGS. 1-3. As another example, the shims 12 and the second shims 10 may be arranged perpendicular to the arrangement shown in FIGS. 1-3, or in any other arrangement, such as, for example, a horizontally-stacked arrangement. The housing 24 may include a plurality of bolts 14 extending through the shims 12, and the second shims 10, and nuts 18 attached to respective bolts 14. The bolts 14 and nuts 18 may maintain a total width of the shims 12 and second shims 10, such that each shim 12 abuts an adjacent second shim 10, and each second shim 10 abuts an adjacent shim 12. The shim 12 and the second shim 10 may have a substantially rectangular cross-section, or any other suitable cross-section, such as, for example, triangular, elliptical, circular, etc. The shim 12 and the second shim 10 may be, for example, bristles, nettings, weaves, springs, etc. Four shims 12 and three second shims 10 are shown, however, it should be understood that any suitable number of shims 12 and second shims 10 may be present.

The housing 24 may be formed of a material such as rubber, wood, metal, foam, or other composites. As one example, the housing 24 may be a solid piece of material, with no shims 12 or second shims 10. The housing 24 may have a substantially rectangular cross-section, or any other suitable cross-section, such as, for example, triangular, elliptical, circular, L-shaped, U-shaped, etc.

The shims 12 and the second shims 10 may be formed of a material such as rubber, wood, metal, foam, or other composites. The shims 12 and the second shims 10 may be formed of the same material, different materials, or any combinations thereof. The shims 12 may be arranged in order of ascending height from the front surface 44 of the housing 24 to the back surface 46 of the housing 24. Alternatively, the shims 12 may be arranged in order of ascending height from the back surface 46 of the housing 24 to the front surface 44 of the housing 24. As another example, the shims 12 may be arranged with a variety of heights and in any suitable configuration.

The housing 24 may include a front plate 16 and a back plate 32. The front plate 16 and the back plate 32 may be separated by the shims 12 and second shims 10. That is, the front plate 16 may abut one of the shims 12 and second shims 10 that is closest to the front surface 44 of the housing 24, and the back plate 32 may abut one of the shims 12 and the second shims 10 that is closest to the back surface 46 of the housing 24. The bolts 14 may extend through the front and back plates 16, 32, and the front and back plates 16, 32 may provide structural support for the bolts 14 and nuts 18.

The handle 26, e.g., at the first end 34, may be connected to the housing 24 by a mounting flange 20 which may be connected to one of the bolts 14. For example, the mounting flange 20 may be connected to one of the bolts 14 that is positioned in a central location relative to the back surface 46 of the housing 24. The mounting flange 20 may be adjustable via a slide or swivel mechanism, such that an angle between the handle 26 and the housing 24 may be adjusted.

The handle 26 may include a first curve 28 and a second curve 30. The first curve 28 may be between the first end 34 and the second curve 30, and the second curve 30 may be between the first curve 28 and the second end 36. The first curve 28 may be at an angle between 0 and 180 degrees, inclusive. The second curve 30 may be at an angle between 0 and 359 degrees, inclusive. The handle 26 may include a first portion 38 extending from the first curve 28 to the first end 34, a second portion 40 extending from the first curve 28 to the second curve 30, and a third portion 42 extending from the second curve 30 to the second end 36. The first portion 38 may extend substantially perpendicular to the back surface 46 of the housing 24 and the third portion 42 may extend substantially parallel to the back surface 46 of the housing 24.

The first portion 38 of the handle 26 may be disposed on a common plane with the bottom surface 50 of the housing 24. That is, if the bottom surface 50 were to be placed on a flat surface, e.g., a ground, the bottom surface 50 and the first portion 38 would each contact the flat surface.

The first curve 28 may act as a fulcrum between the housing 24 and the second and third portions 40, 42 of the handle 26. That is, if the bottom surface 50 were to be placed on a flat surface, e.g., a ground, and a sufficient downward force were to be applied to one of the second portion 40, the second curve 30, and the third portion 42, the first curve 28 would contact the flat surface and the housing 24 would lift off of the flat surface.

Figure 4:
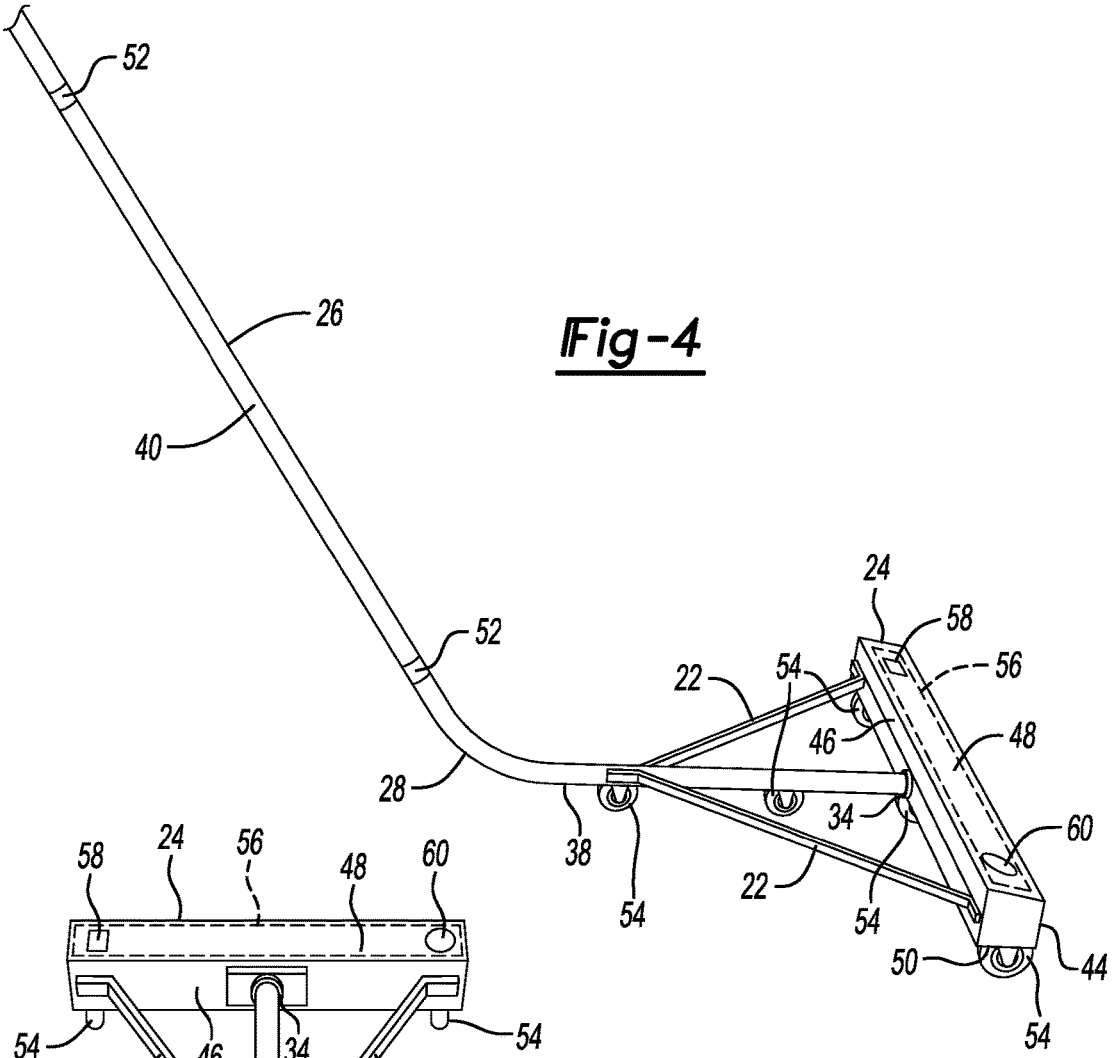
FIG. 4 is a side view of the coaching tool with the housing and the handle shown.
Figure 5:
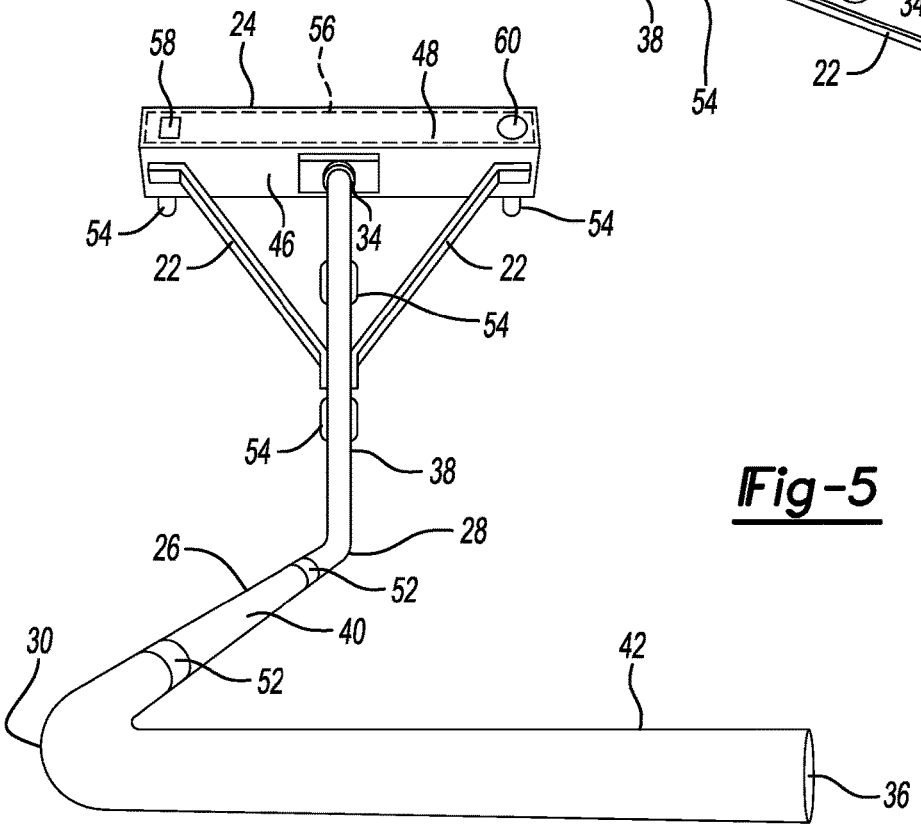
FIG. 5 is a top view of the coaching tool with the housing and the handle shown.

The handle 26 may include a plurality of mechanical linkages 52. For example, as shown in FIGS. 4 and 5, the handle 26 may include two mechanical linkages 52 disposed on the second portion 40 of the handle 26 between the first curve 28 and the second curve 30. Alternatively, there may be any suitable number of mechanical linkages 52 and the mechanical linkages 52 may be situated in any suitable location on the handle 26. The mechanical linkages 52 may allow portions of the handle 26 to be selectively engageable with each other. In some implementations, the mechanical linkages 52 include a female member and a corresponding male member configured to engage the female member. Additionally or alternatively, the mechanical linkages 52 may be any suitable linkage, for example a screw-thread arrangement, an interference fit, a press fit, a friction fit, a latching arrangement, a push button spring mechanism, etc.

The coaching tool may include support struts 22 extending from the back surface 46 of the housing 24 to the first portion 38 of the handle 26. For example, the support struts 22 may be attached to two of the bolts 14. As one example, the support struts 22 may be attached to two of the bolts 14 that are outermost from a center of the housing 24.

The handle 26 may be removably attached to the housing 24. For example, the handle 26 may be attached to the housing 24 by means, such as, rotational attachment, magnets, mechanical fasteners, latches, hook and loop fasteners, or any suitable means.

In one example, at least a portion of the handle 26 may be coated in a material with a greater grip than a material of the rest of the handle 26. For example, one of the first portion 38, first curve 28, second portion 40, second curve 30, and third portion 42 may be coated in the material, or any combination thereof. The handle 26 may be formed of a material such as plastic, rubber, wood, metal, etc. The material with the greater grip may be formed of a material such as plastic, silicone, paint, vinyl, fabric, rubber, wood, metal, foam or other composites.

The coaching tool may include wheels 54 attached to one of the housing 24 and the handle 26. As another example, the coaching tool may include skis, rollers, slides, etc. attached to one of the housing 24 and the handle 26. For example, the wheels, skis, rollers, slides etc. may be attached to the first portion 38 of the handle 26. As another example, stoppers, stakes, braces, etc. may be attached to one of the handle 26 and the housing 24.

The housing 24 may include a force sensor 56 configured to identify a force applied to the housing 24. For example, the force may be from a player stepping on the housing 24. The force sensor may be located, for example, on the top surface 48 of the housing 24. Other force identifying means may be used as a replacement or supplement to the force sensor.

The coaching tool may include a light-emitting source 58 disposed in the housing 24, wherein, upon recognition of the force applied to the housing 24, the light-emitting source may emit a light. The light-emitting source may be a light bulb, a light-emitting diode (LED), liquid-crystal display (LCD), or any other suitable source. The coaching tool may include a sound-emitting source 60 disposed in the housing 24, wherein, upon recognition of the force applied to the housing 24, the sound-emitting source may emit a sound. The sound-emitting source may be a speaker, or any other suitable source. The light-emitting source and the sound-emitting source may operate in conjunction with each other or independently of each other. The housing 24 may include a battery, and the light-emitting source and the sound-emitting source may be powered by the battery.

As one example, a coach, or any other suitable instructor, may operate the coaching tool. A method for coaching footwork development includes the steps of instructing a player to move their feet to a desired location, moving the coaching tool to an undesired location, and providing kinesthetic response to the player through the coaching tool upon the player contacting the coaching tool at the undesired location.

The coach may move the coaching tool by grasping the handle 26 and sliding the coaching tool to the undesired location. The coach may grasp the handle 26 at any suitable location, such as, for example, at the third portion 42.

The coaching tool may emit one of a light and a sound upon the player contacting the coaching tool at the undesired location. In addition to the kinesthetic response, the light and the sound may provide additional sensory responses to the player indicating that the player has moved their feet to the undesired location.

A number of implementations have been described. Nevertheless, it will be understood that various modifications may be made without departing from the spirit and scope of the disclosure. Accordingly, other implementations are within the scope of the following claims.

What is claimed is:

1. A coaching tool for footwork development, comprising:

a plurality of shims arranged parallel to one another;

a housing surrounding the shims, the housing having a top surface, a bottom surface opposite the top surface, a front surface, and a back surface opposite the front surface, the housing and the shims being designed to provide a kinesthetic response to a user upon a foot of the user contacting the housing and the shims, and the kinesthetic response indicating to the user that the foot of the user is in an undesired location as it pertains to the footwork development;

a handle extending from a first end to a second end, the first end being attached to the housing on the back surface, and the second end being spaced from the first end, and a linear portion of the handle between the first end and the second end being disposed on a common plane with the bottom surface of the housing; and a pair of wheels disposed on the linear portion of the handle, the pair of wheels arranged in line with one another along the linear portion with a first wheel of the pair of wheels being disposed closer to the housing than a second wheel of the pair of wheels.

2. The coaching tool of claim 1, wherein the handle includes a first curve and a second curve, the first curve being between the first end and the second curve, and the second curve being between the first curve and the second end.

3. The coaching tool of claim 2, wherein the handle includes a first portion extending from the first curve to the first end, a second portion extending from the first curve to the second curve, and a third portion extending from the second curve to the second end, the first portion extending substantially perpendicular to the back surface of the housing and the third portion extending substantially parallel to the back surface of the housing.

4. The coaching tool of claim 3, further comprising support struts extending from the back surface of the housing to the first portion of the handle.

5. The coaching tool of claim 1, further comprising a plurality of second shims, the second shims being in an alternating arrangement with the shims.

6. The coaching tool of claim 5, wherein the second shims are arranged parallel to one another.

7. The coaching tool of claim 1, further comprising a plurality of bolts extending through the shims and nuts attached to respective bolts.

8. The coaching tool of claim 7, wherein the bolts and nuts are housed within the housing.

9. The coaching tool of claim 1, wherein the shims are arranged in order of ascending height from the front surface of the housing to the back surface of the housing.

10. The coaching tool of claim 1, wherein the handle is removably attached to the housing.

11. The coaching tool of claim 1, further comprising a force sensor configured to identify a force applied to the housing.

12. The coaching tool of claim 11, further comprising a light-emitting source disposed in the housing, wherein, upon recognition of a force applied to the housing, the light-emitting source emits a light indicating to the user that the foot of the user is in an undesired location as it pertains to the footwork development.

13. The coaching tool of claim 12, further comprising a sound-emitting source disposed in the housing, wherein, upon recognition of a force applied to the housing, the sound-emitting source emits a sound indicating to the user that the foot of the user is in an undesired location as it pertains to the footwork development.

14. The coaching tool of claim 11, further comprising a sound-emitting source disposed in the housing, wherein, upon recognition of a force applied to the housing, the sound-emitting source emits a sound indicating to the user that the foot of the user is in an undesired location as it pertains to the footwork development.

15. The coaching tool of claim 1, wherein at least a portion of the handle is coated in a material with a greater grip than a material of the rest of the handle.

* * * * *